US005154837A

United States Patent [19]

Jones

[11] Patent Number: 5,154,837

[45] Date of Patent: Oct. 13, 1992

[54] FLEXIBLE FORM

[76] Inventor: A. Alan Jones, 8538 E. Keim Dr., Scottsdale, Ariz. 85250

[21] Appl. No.: 620,576

[22] Filed: Dec. 3, 1990

[51] Int. Cl.[5] ..... B28B 7/06; E01C 7/00

[52] U.S. Cl. ..... 249/2; 249/4; 249/7; 249/134; 249/135; 249/159

[58] Field of Search ..... 249/2-8, 249/155, 159, 189, 134, 135

[56] References Cited

U.S. PATENT DOCUMENTS

| | | | |
|---|---|---|---|
| 965,979 | 8/1910 | Young | 249/2 |
| 2,626,444 | 1/1953 | Wolf et al. | 249/6 |
| 2,793,416 | 5/1957 | Yearling | 249/6 |
| 3,776,501 | 12/1973 | Loftin | 249/2 |
| 4,156,516 | 5/1979 | Oliver | 249/159 |
| 4,579,312 | 4/1986 | White | 249/6 |
| 4,712,764 | 12/1987 | White | 249/6 |
| 4,776,555 | 10/1988 | Maynard | 249/6 |
| 4,824,068 | 4/1989 | Ferland | 249/2 |

*Primary Examiner*—Jay H. Woo
*Assistant Examiner*—Khanh P. Nguyen
*Attorney, Agent, or Firm*—Sheldon & Mak

[57] ABSTRACT

A flexible form is presented. The flexible form may be shaped to produce the desired contour of concrete or other plastic material in the construction of various structures and is held in place by a plurality of positioning brackets. The flexible form is made of two or more parts, an outer part which provides durability and wear resistance and an inner part which provides the desired flexibility and is protected by the outer part. The parts are assembled in such a manner that each flexes independently of the other parts.

13 Claims, 1 Drawing Sheet

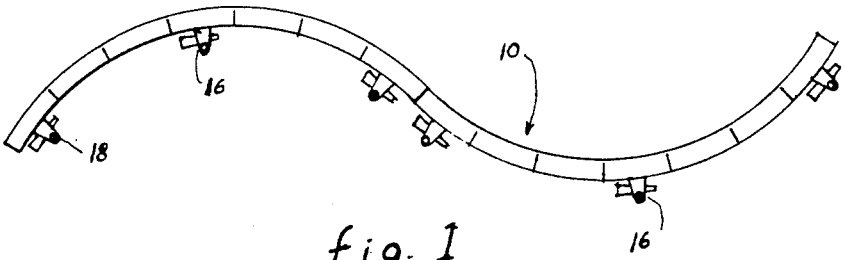
fig. 1
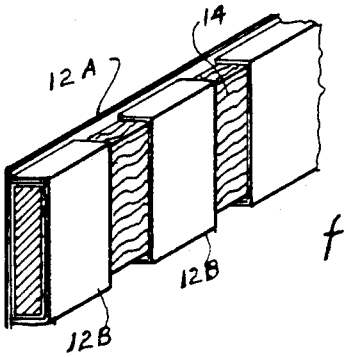
fig. 2
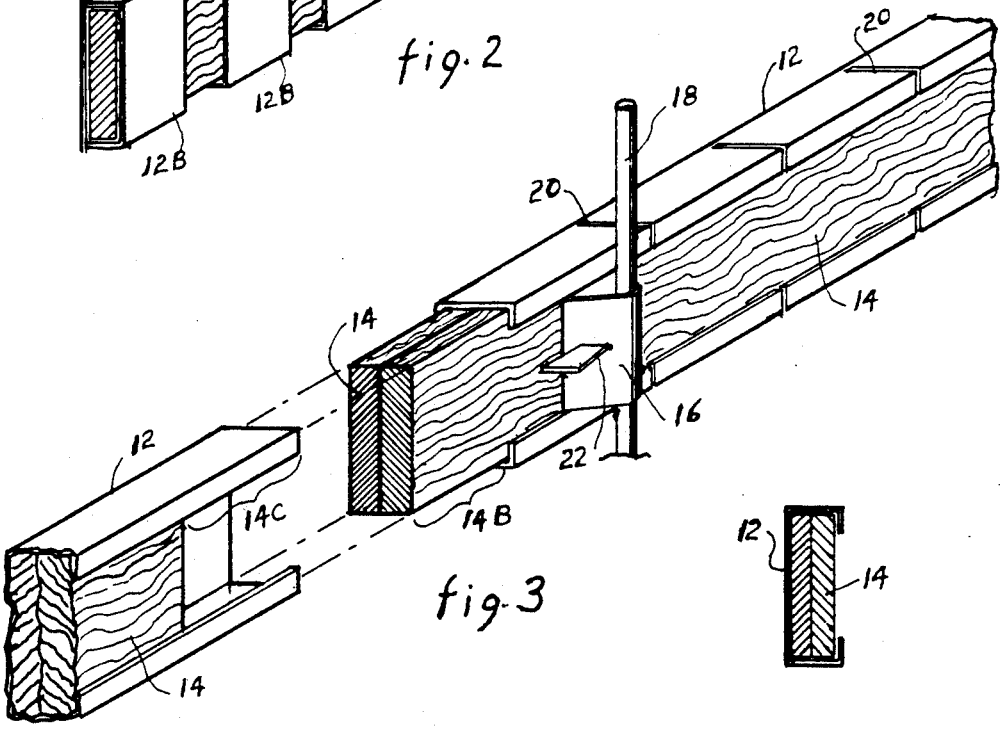
fig. 3
fig. 4

FLEXIBLE FORM

BACKGROUND OF THE INVENTION

The present invention relates generally to forms used for pouring concrete and other plastic material and, more specifically, to a flexible form used to form a curved side or edge in concrete and other plastic materials.

Flexible metal forms are used to form various curves in concrete and other plastic materials as are wood forms. Metal forms, in addition to being difficult to use in their present state, tend to develop sharp permanent bends and kinks rendering them useless for producing smooth curves in the completed structure, while wooden forms, due to rough usage, tend to deteriorate rapidly.

Accordingly there is a need for a flexible form that is durable and wear resistant and will be highly flexible without developing bends and kinks.

SUMMARY OF THE INVENTION

It is an object of this invention to provide a new type of flexible form that may be used to pour concrete and form other plastic material and has the best qualities of flexible steel forms and the best qualities of wood forms without the disadvantages of either.

It is another object of this invention to provide an improved flexible form which is inexpensive to make and is adaptable to be used with existing metal and wood forms.

In accordance with one embodiment of this invention a flexible form for use in forming concrete and other plastic materials is disclosed which comprises an outer encasement of a hard, wear resistant and durable material segmented in such a manner that it can be easily bent, and a separate core made of material that will maintain a controlled curve of various radii and prevent the outer encasement from developing permanent bends or kinks. The flexible form usually comprises, but is not limited to, an elongated shape with one side which limits and forms the shape of the material which is poured against it. The form generally rests on one of its horizontal edges and is held in place and proper contour by stakes or other means which are inserted in brackets that are attached to the flexible form at certain positions on the form. The core material can be one or more plies which freely flex inside the containment of the outer encasement thus allowing the flexibility required for forming curved surfaces of the concrete or other plastic material. The core material must be flexible enough to bend to the required contour but sufficiently rigid to prevent permanent bends to develop in the outer encasement.

The foregoing and other objects, features and advantages of this invention will be apparent from the following, more particular, description of the preferred embodiments of the invention, as illustrated in the accompanying drawings.

BRIEF DESCRIPTION OF THE DRAWINGS

FIG. 1 is a top view showing two flexible forms joined, one forming an inside curve and one forming an outside curve.

FIG. 2 shows one type of design of the outer encasement which holds the inner core material in place and a single ply of inner core material.

FIG. 3 is a perspective view of a different design of the outer encasement with two plies of core material and illustrates by dashed lines how the two opposing ends of the connecting form panels can be fitted and joined together.

FIG. 4 is a sectional drawing showing the relative positions of the outer encasement and the inner core material.

DESCRIPTION OF THE PREFERRED EMBODIMENT

FIG. 1 shows two sections of the flexible form, generally designated by the reference number 10. The flexible form 10 is made in two general parts, an outer encasement 12 is made of steel or other hard material so as to resist wear and abrasion and an inner core 14 of one or more plies, made of wood, fiberglass or other material that will flex to the desired configuration but is rigid enough to prevent the outer encasement from developing permanent bends or kinks. The flexible form 10 is held in place by brackets 16 and stakes 18 or other firm mechanical means.

FIG. 2 shows one method of constructing the outer encasement 12 whereby a plurality of shaped sections 12B are spaced along and secured to a flat panel 12A thus holding the inner core 14 in place. The spaces between the shaped sections 12B allow the completed flexible form 10 to bend while the inner core 14 prevents excessive bending thus preventing permanent bends and kinks from developing in the outer encasement 12. Another way to make the outer encasement 12 is shown in FIG. 3 whereby the outer encasement 12 is bent or molded in one piece with slots 20 cut or molded in the flange portion only, not extending into the vertical side, thereby allowing the outer encasement 12 to bend at each slot 20. The inner core 14 is shown in two plies and is made of a material such as wood or fiberglass that will bend but not kink so as to allow only a slight bend at each slot 20 in the outer encasement 12. FIG. 3 also shows how the inner core 14 can be extended a distance 14B from the end of the outer encasement 12 thus forming a cavity 14C in one end of the flexible form and a tongue in the other end allowing two forms to be joined by sliding the tongue of one form into the cavity of the next form as indicated by the dashed lines. Other means of joining the flexible form panels 10 can be used. The stake pocket 16 accepts the stake 18 which is driven through the stake pocket 16 into the ground. The form is thus positioned and then secured by the wedge 22 which tightens the stake 18 against the stake pocket 16. Other means of holding the flexible form 10 in its proper position can be used.

FIG. 4 is a sectional view of one configuration of the flexible form 10 showing two plies of the inner core 14 with the outer encasement 12 holding them in place. The parts of the inner core 14 and the outer encasement 12 are not secured rigidly together thus allowing free movement of one part in relation to the others facilitating the flexing of the flexible form 10 and allowing it to easily bend and conform to the desired shape.

While the invention has been particularly shown and described in reference to the preferred embodiments thereof, it will be understood by those skilled in the art that changes in the form and details may be made therein without departing from the scope of the invention.

I claim:

1. A flexible form for use in forming a moldable material during solidification thereof, the form comprising:

(a) a face member including an elongated continuous panel having a front forming face for contacting the moldable material;

(b) a longitudinally flexible core member; and (c) guide means for longitudinally slidably locating the core member in a laterally fixed position proximate the face member and opposite the front forming face thereof for enabling the form to flex while preventing permanent bends and kinks from developing in the face member, comprising:

(i) a rear guide face of the face member, the rear guide face being parallel-spaced from the front forming face;

(ii) a spaced plurality of first and second flange portions extending rearwardly from the rear guide face; and (iii) a rear portion of each first flange portion extending in parallel-spaced relation to the face member for slidably locating at least a portion of the core member between the rear portion and the continuous panel of the face member, the core member substantially laterally extending between the face member and corresponding rear portions of the first flange portions, the core member also bearing against the rear guide face of the guide member when the form is flexed.

2. The form of claim 1, wherein the guide means is integrally formed with the face member.

3. The form of claim 1, wherein the core member includes at least two plies of material slidable relative to each other.

4. The form of claim 1, wherein the face member is made of a material selected from the group consisting of steel, aluminum, and rigid plastic.

5. The form of claim 1, the core member has a uniform cross-sectional envelope throughout a major longitudinal portion thereof.

6. The form of claim 1, wherein the core member is made of wood.

7. The form of claim 1, wherein the core member is made of fiberglass.

8. The form of claim 1, further comprising a plurality of spaced apart stake pockets for anchoring the form, each stake pocket being fixably mounted to the face member rearwardly of the front forming face.

9. A flexible form for use in forming a moldable material during solidification thereof, the form comprising:

(a) a face member including an elongated continuous panel having a front forming face for contacting the moldable material, the face member having a rear guide face, the rear guide face being parallel-spaced from the front forming face, the face member also having upper and lower flanges extending behind the rear face, each flange having a rear portion extending toward the other flange parallel to and spaced from the rear face to form a space between the portions, the flanges, and a rear guide face of the face member, the rear guide face being parallel spaced from the front forming face;

(b) a longitudinally flexible core member; and (c) guide means for longitudinally slidably locating the core member in a laterally fixed position proximate the face member and opposite the front forming face thereof for enabling the form to flex while preventing permanent bends and kinks from developing in the face member, the core member substantially laterally extending between the rear guide face of the face member and corresponding rear portions of the flanges, the core member also bearing against the rear guide face of the guide member when the form is flexed.

10. A flexible form for use in forming a moldable material during solidification thereof, the form comprising:

(a) a face member including an elongated continuous panel having a front forming face for contacting the moldable material;

(b) a longitudinally flexible core member; and (c) guide means for longitudinally slidably locating the core member in a laterally fixed position proximate the face member and opposite the front forming face thereof for enabling the form to flex while preventing permanent bends and kinks from developing in the face member, the guide means comprising a longitudinally spaced plurality of C-shaped members, each of the C-shaped members being connected at opposite flange extremities thereof to the face member for enclosing a portion of the core member, the core member substantially laterally extending between the face member and corresponding web portions of the C-shaped members, the core member also bearing against the guide member when the form is flexed.

11. The form of claim 10, wherein the core member includes at least two plies of material slidable relative to each other.

12. The form of claim 10, wherein the core member is made of a material selected from the group consisting of wood and fiberglass.

13. The form of claim 10, further comprising a plurality of spaced apart stake pockets for anchoring the form, each stake pocket being fixably mounted to the face member rearwardly of the front forming face.

* * * * *